US008834188B2

(12) United States Patent
Wang et al.

(10) Patent No.: US 8,834,188 B2
(45) Date of Patent: Sep. 16, 2014

(54) MEMORY CONNECTOR

(71) Applicant: Huawei Technologies Co., Ltd., Guangdong (CN)

(72) Inventors: Zhonghua Wang, Hangzhou (CN); Yinzhong Tang, Shenzhen (CN); Biye Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/080,251

(22) Filed: Nov. 14, 2013

(65) Prior Publication Data

US 2014/0073154 A1 Mar. 13, 2014

Related U.S. Application Data

(63) Continuation of application No. PCT/CN2011/075667, filed on Jun. 13, 2011.

(51) Int. Cl.

| | |
|---|---|
| ***H01R 13/62*** | (2006.01) |
| ***H01R 13/633*** | (2006.01) |
| ***H01R 12/70*** | (2011.01) |
| *H01R 12/72* | (2011.01) |

(52) U.S. Cl.

CPC ..... *H01R 13/6335* (2013.01); *H01R 12/721* (2013.01); *H01R 12/7029* (2013.01)

USPC ..... 439/157

(58) Field of Classification Search

USPC ..... 439/157, 160

See application file for complete search history.

(56) References Cited

U.S. PATENT DOCUMENTS

| | | | | |
|---|---|---|---|---|
| 5,470,242 | A | 11/1995 | Cheng et al. | |
| 5,746,613 | A | 5/1998 | Cheng et al. | |
| 6,132,228 | A | 10/2000 | Lang | |
| 7,004,773 | B1 | 2/2006 | Poh et al. | |
| 8,328,567 | B1 * | 12/2012 | Yang | 439/157 |
| 8,444,424 | B2 * | 5/2013 | Shen et al. | 439/153 |
| 2011/0237101 | A1 * | 9/2011 | Yang | 439/153 |

FOREIGN PATENT DOCUMENTS

| | | | |
|---|---|---|---|
| CN | 2384323 | Y | 6/2000 |
| CN | 2442303 | Y | 8/2001 |
| CN | 101258788 | A | 9/2008 |

* cited by examiner

*Primary Examiner* — Phuong Dinh

(74) *Attorney, Agent, or Firm* — Leydig, Voit & Mayer, Ltd.

(57) ABSTRACT

An embodiment of the present invention provides a memory connector including a base and ejector levers arranged at two ends of the base, where at least one of the ejector levers includes a fastener and a force-applying handle, the fastener is connected to the force-applying handle, a lower part of the force-applying handle is connected to the base, the force-applying handle is a planar structure, an inner surface of the planar structure and a lateral side of a memory module are arranged face to face, and the inner surface of the force-applying handle is used to apply a pulling force to the outside of the base, to cause the fastener to break away from a groove on the memory module. In the present invention, an operation of opening an ejector lever is implemented by means of a pulling force, thereby bringing operation comfort and saving a layout space.

7 Claims, 3 Drawing Sheets

MEMORY CONNECTOR

CROSS-REFERENCE TO RELATED APPLICATIONS

This application is a continuation of International Patent Application No. PCT/CN2011/075667, filed on Jun. 13, 2011, which is hereby incorporated by reference in its entirety.

TECHNICAL FIELD

The present invention relates to the field of communications, and in particular, to a memory connector.

BACKGROUND

A memory module is an indispensable component of a computer device. In an installation process, a memory module needs to be installed on a memory connector for easy plugging and unplugging.

FIG. 1 shows an existing memory connector, including a base 1 and ejector levers 6 arranged at two ends of the base, where anti-skid lines 6.1 are arranged at top force-applying positions of the ejector levers 6 at the two ends. When a memory module 4 needs to be unplugged, the anti-skid lines 6.1 of the ejector levers 6 at the two ends are pressed to raise the ejector levers 6 towards two sides through a generated friction force, to cause the ejector levers 6 to eject the memory module 4 and to smoothly take out the memory module 4.

In the process of implementing the present invention, the inventor finds at least the following problems in the prior art: (1) The ejector levers need to extend along two sides of the memory module so as to ensure a sufficient force-applying area, thereby causing an excessively large width of the memory connector and a large occupied layout space; (2) In an existing operation manner, in addition to the space which needs to be considered for completely opening the ejector levers during layout, and an operation space also needs to be reserved for hands on the two sides of the ejector levers, but some tall components or modules cannot be placed on the two sides of the memory connector, thereby greatly restricting the layout; (3) The force is applied in a manner of a friction force, and a relatively great pulling force is required when the memory module and the memory connector are relatively tightly mated with each other, causing very poor operation comfort.

SUMMARY

Objectives of the present invention are to provide a memory connector that brings operation comfort and saves a layout space so as to resolve the foregoing defects of the prior art.

To achieve the foregoing objectives, the present invention adopts technical solutions as follows:

A memory connector, including a base and ejector levers arranged at two ends of the base, where at least one of the ejector levers includes a fastener and a force-applying handle, the fastener is connected to the force-applying handle, a lower part of the force-applying handle is connected to the base, the force-applying handle is a planar structure, an inner surface of the planar structure and a lateral side of a memory module are arranged face to face, and the inner surface of the force-applying handle is used to apply a pulling force to the outside of the base, to cause the fastener to break away from a groove on the memory module.

The beneficial effects of the technical solutions provided in the embodiments of the present invention are as follows: An operation of opening an ejector lever is implemented by means of a pulling force to eject a memory module, thereby bringing operation comfort and saving a layout space.

In the figures, 1 is a base, 1.1 is a base body, 1.2 is a connector head, 2 is a first ejector lever, 2.1 is a first fastener, 2.2 is a first force-applying handle, 2.21 is an inner surface of the first force-applying handle, 3 is a second ejector lever, 3.2 is a second force-applying handle, 3.1 is a second fastener, 4 is a memory module, 4.1 is a lateral side, 5 is a groove, 6 is an ejector lever, and 6.1 is an anti-skid line.

DESCRIPTION OF EMBODIMENTS

To make the objectives, technical solutions, and advantages of the present invention more comprehensible, the following further describes the embodiments of the present invention in detail with reference to the accompanying drawings.

Figure 2:
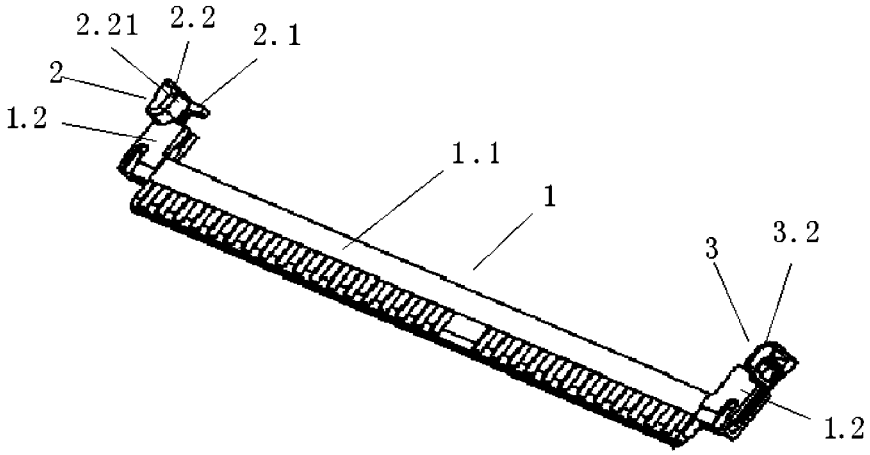
FIG. 2 is a schematic structural diagram of a memory connector according to an embodiment of the present invention.
Figure 3:
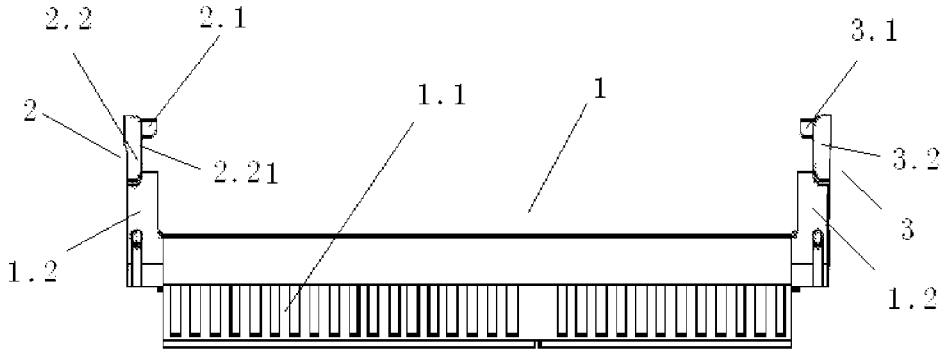
FIG. 3 is a front view of FIG. 2.
Figure 4:
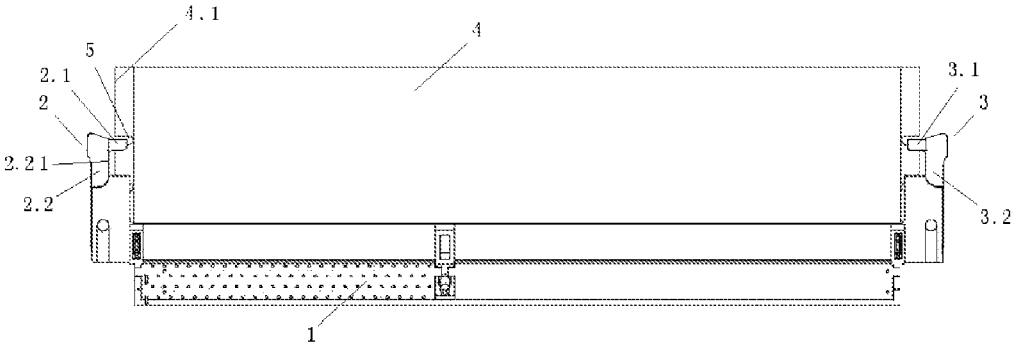
FIG. 4 is a schematic structural diagram of connecting a memory connector to a memory module according to an embodiment of the present invention.

Referring to FIG. 2 and FIG. 3, a memory connector is provided, including a base 1, where the base 1 includes a base body 1.1 and connectors 1.2 arranged at two sides of the base body 1.1, a first ejector lever 2 is arranged at one end of the base 1, a second ejector lever 3 is arranged at the other end of the base 1, the first ejector lever 2 includes a first fastener 2.1, the first fastener 2.1 is connected to a first force-applying handle 2.2, a lower part of the first force-applying handle 2.2 is connected to the connector 1.2, the first force-applying handle 2.2 is a planar structure, an inner surface 2.21 of the first force-applying handle and a lateral side of a memory module 4 (as shown in FIG. 4) are arranged face to face, and the inner surface 2.21 of the first force-applying handle is used to apply a pulling force to the outside of the base 1, to cause the first fastener 2.1 to break away from a groove 5 on the memory module 4.

In this embodiment of the present invention, a conventional form of opening a memory connector is changed, so that an operation of opening an ejector lever is implemented by means of a pulling force. After a pulling force is applied from an inner surface 2.21 of a first force-applying handle to the outside of a base 1, a first ejector lever 2 rotates, to cause a first fastener 2.1 to break away from a groove on a memory module 4 to eject the memory module 4. In this way, embodiments of the present invention brings better operation comfort and saves a layout space because the width of an ejector lever structure is decreased.

Referring to FIG. 4, the inner surface 2.21 of the first force-applying handle is a force-applying surface. The force-applying surface is arranged in parallel to the lateral side 4.1 of the memory module 4.

When an area of the force-applying surface of the first force-applying handle needs to be increased, the area of the force-applying surface of the first force-applying handle may be appropriately increased in a direction vertical to an upper surface of the memory module, without the need of increasing a width of the entire memory connector, thereby ensuring a layout space on two sides of the memory connector.

Referring to FIG. 3, a first fastener 2.1 is connected to one end of a top of the first force-applying handle 2.2, and the first fastener 2.1 may also be arranged on the top of the first force-applying handle 2.2, while a bottom of the first force-applying handle 2.2 is fastened on the base 1.

When the first ejector lever 2 needs to be opened, a hand is placed on the upper surface of the memory module 4 (as shown in FIG. 4) and an inner side of the ejector lever to apply a pulling force to the inner surface 2.21 of the first force-applying handle. Only a space needs to be considered for completely opening the first ejector lever 2, and no operation space for the hand needs to be reserved on two sides of the first ejector lever 2.

Figure 5:
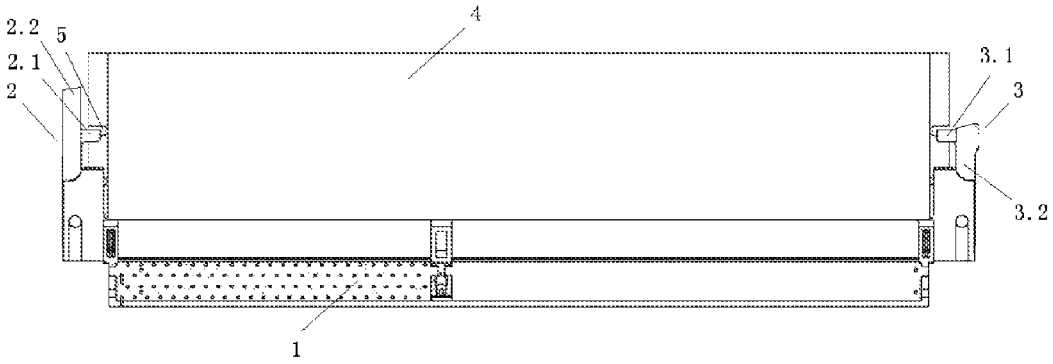
FIG. 5 is another schematic structural diagram of connecting a memory connector to a memory module according to an embodiment of the present invention.

Referring to FIG. 5, the first fastener 2.1 may also be arranged in the middle of the first force-applying handle 2.2, and the second ejector lever 3 may connect to a second force-applying handle 3.2 by using a second fastener 3.1, and a lower end of the second force-applying handle 3.2 is fastened on a structure of the base 1.

Similarly, when the hand is placed on the inner side of the ejector lever to push the inner surface 2.21 of the first force-applying handle and an inner surface of the second force-applying handle 3.2, to make the first fastener 2.1 and the second fastener 3.1 break away from the groove 5 on the memory module 4, so that the memory module 4 is smoothly plugged or unplugged.

Referring to FIG. 3, for ease of production, the first force-applying handle 2.2 and the first fastener 2.1 is a unibody structure.

Referring to FIG. 2 and FIG. 3, the second ejector lever 3 and the first ejector lever 2 at two ends of the base 1 may use same structure, and the inner surface of the second force-applying handle 3.2 and the inner surface 2.21 of the first force-applying handle are arranged face to face.

Because an ejector lever is opened by using a pulling force and a thumb is placed on the inner side of the ejector lever during the operation to apply the force to a force-applying surface at the inner side of the ejector lever, no operation space needs to be reserved at two sides of the ejector lever, and therefore a greater layout space may be saved. With the structure in embodiments of the present invention, a width of a memory connector is reduced, an operation space required for an existing structure is saved, and side-by-side layout of memory modules can be implemented on a module with a standard 8U (322.25 mm) width. During the layout of the module with the standard 8U width (322.25 mm), a 4.5 mm guide rail space is reserved on each side. When two groups of memory modules are horizontally placed side by side, an operation space of at least 10 mm is reserved between the memory modules. In this case, the remaining size is 303.25 mm, and a maximum width of opening each memory connector cannot exceed 151.6 mm. The foregoing layout can be implemented by using the memory connector provided in the present invention. When an ejector lever is not opened, the total width of the memory connector according to the present invention is 142.6 mm. After the ejector lever is opened, the total width is 156.1 mm.

Figure 1:
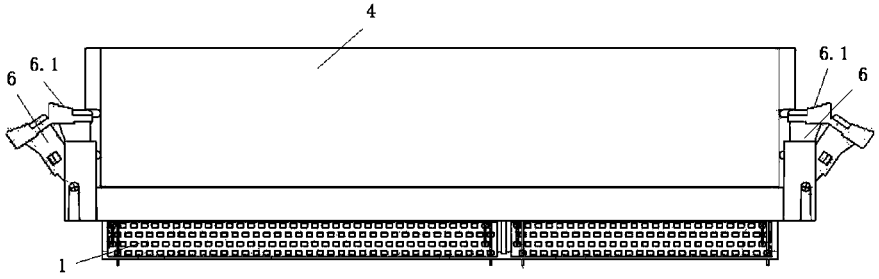
FIG. 1 PRIOR ART
FIG. 1 is a schematic structural diagram of a memory connector in a process of opening an ejector lever according to the prior art.

Referring to FIG. 1 and FIG. 2, the first ejector lever 2 uses the structure provided in embodiments of the present invention, and the second ejector lever 3 may use either the structure provided in embodiments of the present invention or the structure provided in the prior art. The second fastener 3.1 is connected to the second force-applying handle 3.2. The second force-applying handle 3.2 is configured to apply a force to the upper surface, and an anti-skid line is further arranged on the upper surface. During opening of the second ejector lever, the force applies to the upper surface, to cause, through a generated friction force, the second fastener 3.1 to break away from the groove on the memory module, so that the second ejector lever 3 is opened.

The foregoing descriptions are merely exemplary embodiments of the present invention, but are not intended to limit the present invention. Any modifications, equivalent replacements, or improvements made within the idea and principle of the present invention shall fall within the protection scope of the present invention.

What is claimed is:

1. A memory connector, comprising a base and ejector levers, the ejector levers are arranged at either end of the base, wherein at least one of the ejector levers comprises a fastener and a force-applying handle, the fastener is connected to the force-applying handle, a lower part of the force-applying handle is connected to the base, the force-applying handle is a planar structure, an inner surface of the planar structure and a lateral side of a memory module are arranged face to face, and the inner surface of the planar structure is used to apply a pulling force to outside of the base, to cause the fastener to break away from a groove on the memory module;

wherein the inner surface of the planar structure is arranged in parallel to the lateral side of the memory module.

2. The memory connector according to claim 1, wherein the fastener is arranged at one end of a top of the force-applying handle.

3. The memory connector according to claim 1, wherein the fastener is arranged in the middle of the force-applying handle.

4. The memory connector according to claim 1, wherein the force-applying handle and the fastener are integrated.

5. The memory connector according to claim 1, wherein the ejector levers includes a first ejector lever and a second ejector lever, the first ejector lever and the second ejector lever have the same structure, and force-applying surfaces of the first and second ejector levers are arranged face to face.

6. The memory connector according to claim 1, wherein one of the ejector levers causes, through a generated friction force, the fastener to break away from the groove on the memory module.

7. The memory connector according to claim 6, wherein an anti-skid line is arranged on an upper surface of a force-applying handle of one of the ejector levers.

* * * * *

UNITED STATES PATENT AND TRADEMARK OFFICE

CERTIFICATE OF CORRECTION

PATENT NO. : 8,834,188 B2
APPLICATION NO. : 14/080251
DATED : September 16, 2014
INVENTOR(S) : Wang et al.

It is certified that error appears in the above-identified patent and that said Letters Patent is hereby corrected as shown below:

Title Page, Applicant, item [71], "Guangdong (CN)" should read -- Shenzhen (CN) --.

Signed and Sealed this
Third Day of February, 2015

Michelle K. Lee

Michelle K. Lee
*Deputy Director of the United States Patent and Trademark Office*